US005970284A

United States Patent [19]

Garcia et al.

[11] Patent Number: 5,970,284

[45] Date of Patent: Oct. 19, 1999

[54] SLIDE COVER FOR MARKING PARTICLE RECEPTACLE

[75] Inventors: Christopher S. Garcia; Ronald R. Holland; Scott H. Schwallie, all of Rochester, N.Y.

[73] Assignee: Eastman Kodak Company, Rochester, N.Y.

[21] Appl. No.: 09/052,686

[22] Filed: Mar. 31, 1998

[51] Int. Cl.[6] ..... G03G 15/08

[52] U.S. Cl. ..... 399/120; 399/258; 399/260; 399/262; 222/DIG. 1; 220/331

[58] Field of Search ..... 399/120, 258, 399/260, 262, 106; 222/DIG. 1, 561; 141/364, 351, 352, 353, 354; 220/331, 351; D18/40, 43

[56] References Cited

U.S. PATENT DOCUMENTS

| | | | |
|---|---|---|---|
| D. 308,073 | 5/1990 | Nakamura | D18/43 |
| D. 310,845 | 9/1990 | Ohata | D18/43 |
| D. 366,278 | 1/1996 | Nagashima | D18/43 |
| D. 394,451 | 5/1998 | Okada | D18/43 |
| 2,569,254 | 9/1951 | Page | 220/331 X |
| 2,804,230 | 8/1957 | Attias et al. | 220/331 |
| 4,260,069 | 4/1981 | Juergens | 220/331 |
| 4,972,887 | 11/1990 | Hacknauer et al. . | |
| 4,997,016 | 3/1991 | Hacknauer et al. . | |
| 5,040,024 | 8/1991 | Fukuda et al. | 222/DIG. 1 |
| 5,175,588 | 12/1992 | Katagata . | |
| 5,313,993 | 5/1994 | Corby et al. . | |
| 5,517,285 | 5/1996 | Nomura et al. | 399/120 |
| 5,592,980 | 1/1997 | Stern et al. . | |
| 5,730,451 | 3/1998 | Walker | 220/331 X |
| 5,737,675 | 4/1998 | Okada et al. | 399/258 |

*Primary Examiner*—Matthew S. Smith
*Attorney, Agent, or Firm*—Lawrence P. Kessler

[57] ABSTRACT

A receptacle for particulate matter to be supplied to a reproduction apparatus. The receptacle includes a container adapted to store particulate matter. The container has an opening defined therein, and a flange located about the defined opening so as to facilitate placement and removal of the receptacle with the reproduction apparatus. A slide cover is supported by the flange for selective movement to a first position covering the defined opening and a second position uncovering the defined opening. The slide cover is releasably secured to the container in an out of the way location when the slide cover is in the second position.

6 Claims, 10 Drawing Sheets

SLIDE COVER FOR MARKING PARTICLE RECEPTACLE

CROSS REFERENCE TO RELATED APPLICATIONS

U.S. patent appl. Ser. No. 09/052,475, filed Mar. 31, 1998, entitled "SLIDE COVER BREATHABLE SEAL FOR A MARKING PARTICLE RECEPTACLE" in the name of Christopher S. Garcia et al.

U.S. patent appl. Ser. No. 08/052,717, filed Mar. 31, 1998, entitled "IDENTIFYING FEATURES ASSOCIATED WITH THE SLIDE COVER FOR A MARKING PARTICLE RECEPTACLE" in the name of Christopher S. Garcia et al.

U.S. patent appl. Ser. No. 09/052,620, filed Mar. 31, 1998, entitled "RECEPTACLE FOR PARTICULATE MATTER" in the name of Christopher S. Garcia et al.

FIELD OF THE INVENTION

This invention relates in general to marking particle receptacles utilized for supplying particulate material to the development station of a reproduction apparatus, and more particularly to a marking particle receptacle with a slide cover for selectively closing the receptacle and which is readily retained in an out of the way location when the receptacle is operatively associated with the reproduction apparatus development station.

BACKGROUND OF THE INVENTION

Typical commercial reproduction apparatus include electrostatographic process copier/duplicators or printers, for example. With such reproduction apparatus, pigmented marking particles are utilized to develop an electrostatic latent image of information to be reproduced on a dielectric support member for transfer to a receiver member, or directly onto a receiver member. The receiver member bearing the transferred marking particle developed image is transported through a fuser device where the marking particle image is fixed (fused) to the receiver member, for example, by heat and pressure to form a permanent reproduction.

The marking particles for developing the electrostatic latent image are supplied to the reproduction apparatus development station in a receptacle removably connected to a receiving apparatus for the development station. U.S. Pat. No. 4,972,887 (issued Nov. 27, 1990, in the names of Hacknauer et al), shows a marking particle receptacle having a particle-containing portion with a base. The base has an opening facing downward in use and a flange extending outward from the opening. A cover is slidably secured to the flange. A receiving apparatus for the receptacle includes a replenisher sump for receiving marking particles through the base of the receptacle when the opening of the receptacle is positioned directly above the sump. The receptacle with the slide cover is positioned beside the replenisher sump, and the receptacle particle containing portion is slid off the cover and over the replenisher sump, with the flange sliding on a receiving surface that surrounds an opening for the replenisher sump.

The receptacle particle containing portion is moved back over the cover, after the receptacle is emptied, to prevent the escape of residual marking particles remaining in the marking particle receptacle during removal and further handling in recycling of the receptacle. The slide cover employs a hinge to enable it to move out of the way when the receptacle is operatively located relative to the replenisher sump of the reproduction apparatus development station. However, there is no mechanism for retaining the slide cover in such position. As such, the slide cover and it seal, are subject to damage during operation of the reproduction apparatus.

SUMMARY OF THE INVENTION

In view of the above, this invention is directed to a marking particle receptacle and slide cover which is readily retained in an out of the way location when the receptacle is operatively associated with the reproduction apparatus development station. The receptacle includes a container adapted to store particulate matter. The container has an opening defined therein, and a flange located about the defined opening so as to facilitate placement and removal of the receptacle with the reproduction apparatus. A slide cover is supported by the flange for selective movement to a first position covering the defined opening and a second position uncovering the defined opening. The slide cover is releasably secured to the container in an out of the way location when the slide cover is in the second position.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Referring now to the accompanying drawings, a particulate matter receptacle with slide cover, according to this invention, is generally designated by the numeral 10, and is best shown in FIGS. 1–6. The receptacle 10, as more fully described in copending U.S. Ser. No. 09/052,620, is of a substantially two-piece construction including a blow molded plastic container 12 and an injection molded support flange 14 joined thereto. The particular shape of the housing of the container 12 is selected to provide a maximum particulate matter storage capacity with a minimum resistance to particulate matter flow as the particulate matter fills or empties from the container.

In the particular embodiment shown herein, the particulate matter is pigmented marking particles adapted to be used as image development material in reproduction apparatus, such as copier/duplicators or printers for example. The container 12 of the receptacle 10 has several built-in features 16*a*–16*e*. The built-in features 16*a*–16*d* of the container 12 provide for improved handling of the receptacle and facilitate its placement and removal in a reproduction apparatus with which the receptacle is adapted to be associated. The features 16*a*–16*d* are particularly shaped recesses formed in opposed generally upstanding front (12*f*) and rear (12*r*) walls of the container. The recesses are adapted to be readily gripped by human hands. The orientation and configuration of the recesses are selected to cause the hands to be optimally positioned for comfortably handling the receptacle 10, and for facilitating the sliding of the receptacle into and out of the reproduction apparatus. That is, the recesses 16*a*–16*d* are shaped to readily accommodate the thumbs and fingers of a user, respectively, in opposed relationship to provide for a secure grip on the receptacle 10. Further, the recesses are located approximately about the center of gravity of a filled receptacle so that lifting and maneuvering of the receptacle, from a flange-on-top position (for filling and storage) to a flange-on-bottom position (for loading/unloading), is readily accomplished. The built-in feature 16*e* (see FIG. 1) is also a recess formed in the upstanding front wall 12*f* of the container 12. The particular purpose of the feature 16*e* will become fully apparent with reference to the explanation provided below.

Figure 1:
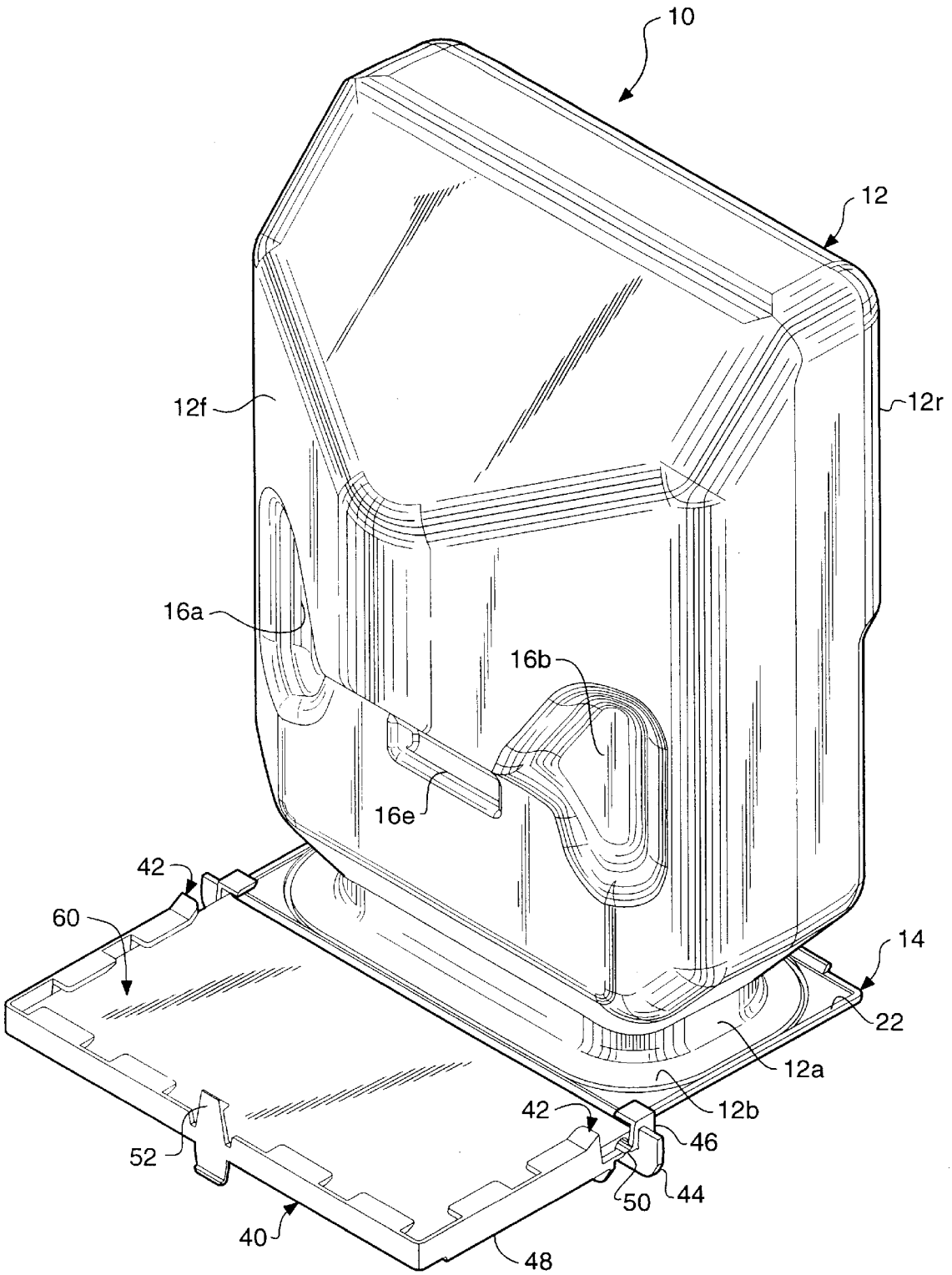
FIG. 1 is a view, in perspective, of a marking particle receptacle and a slide cover for the receptacle, according to this invention, in the open, extended position.
Figure 2:
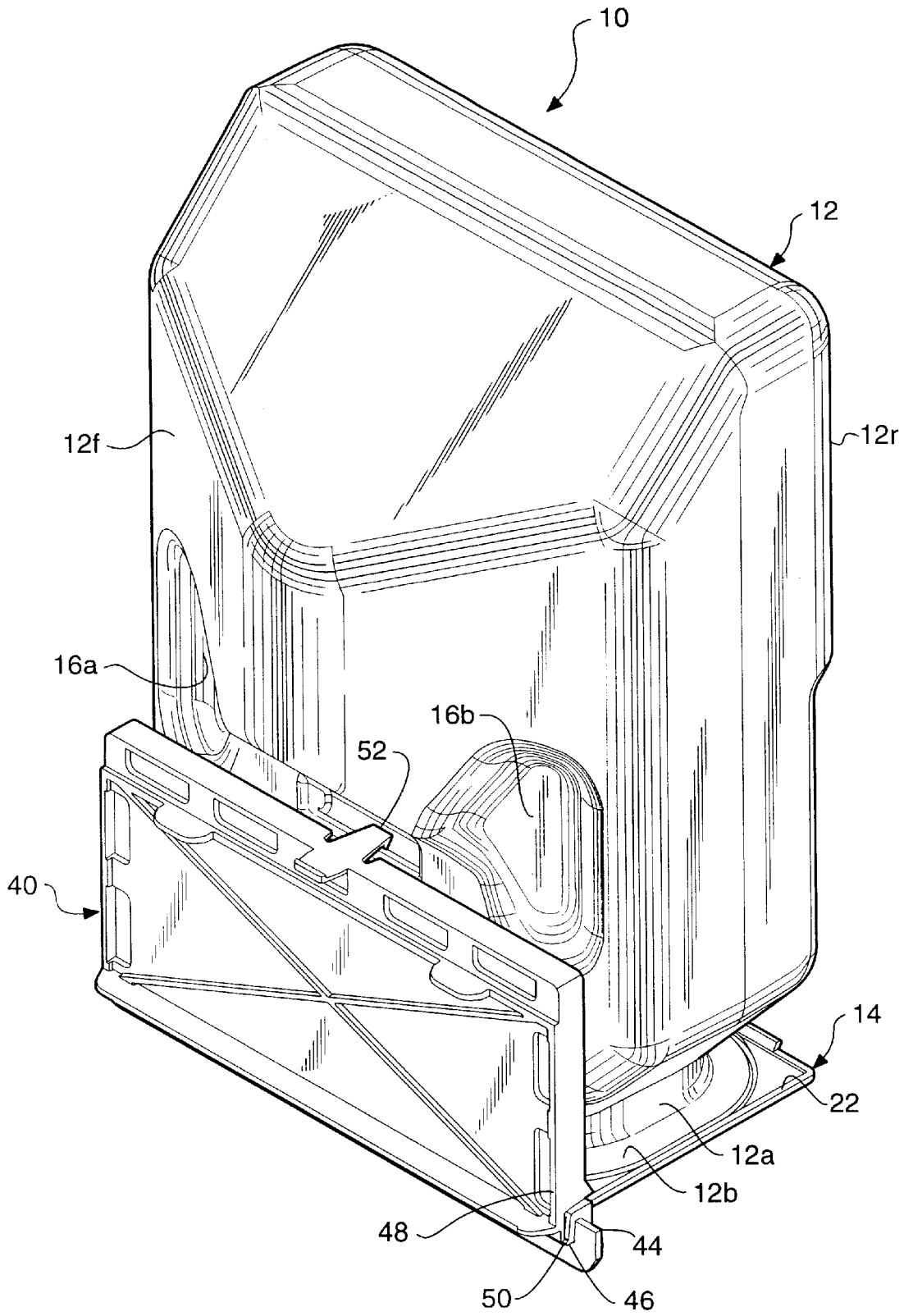
FIG. 2 is a view, in perspective, of a marking particle receptacle and a slide cover for the receptacle, according to this invention, in the open, folded out of the way position.
Figure 3:
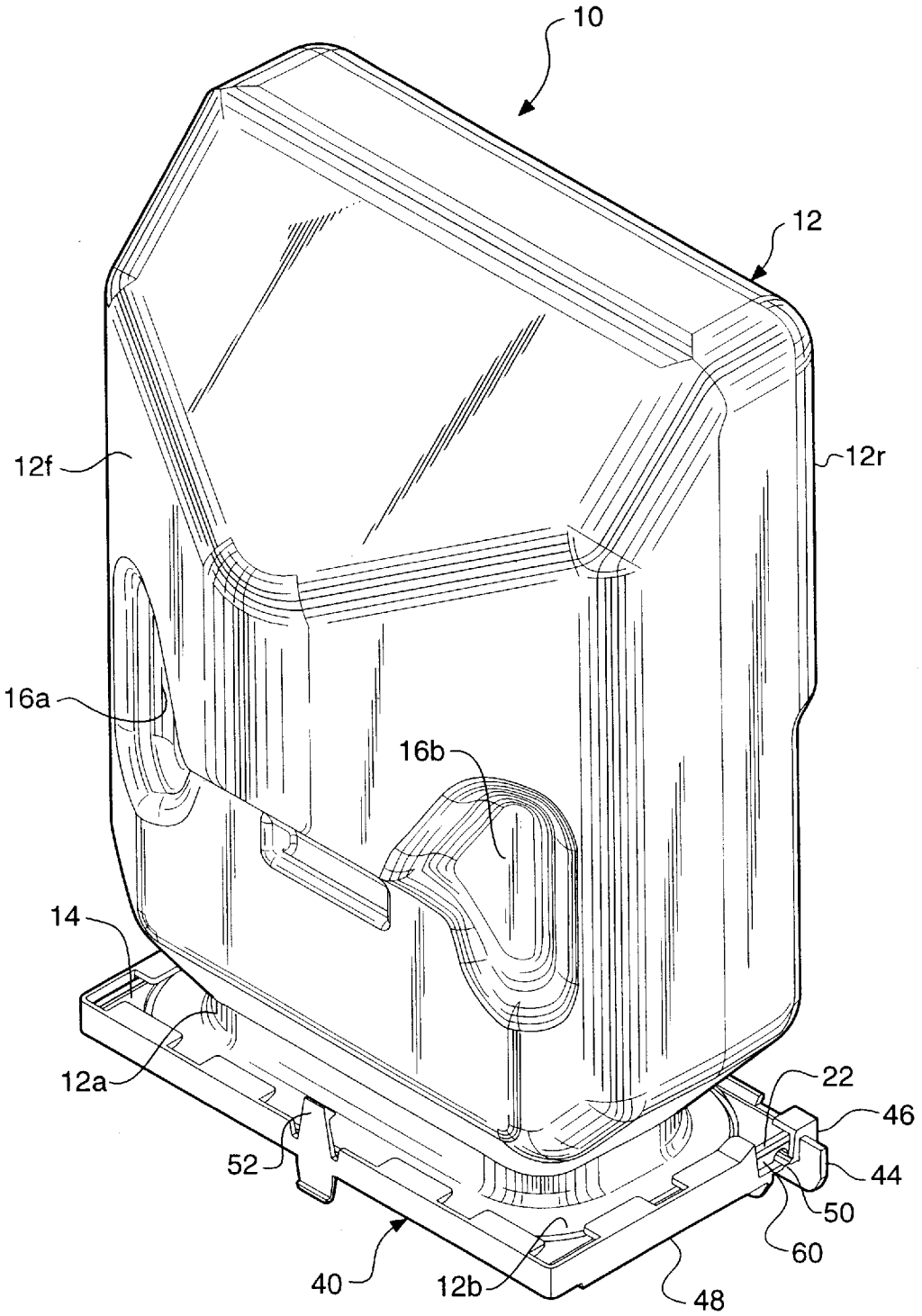
FIG. 3 is a view, in perspective, of a marking particle receptacle and a slide cover for the receptacle, according to this invention, in the closed position.
Figure 4:
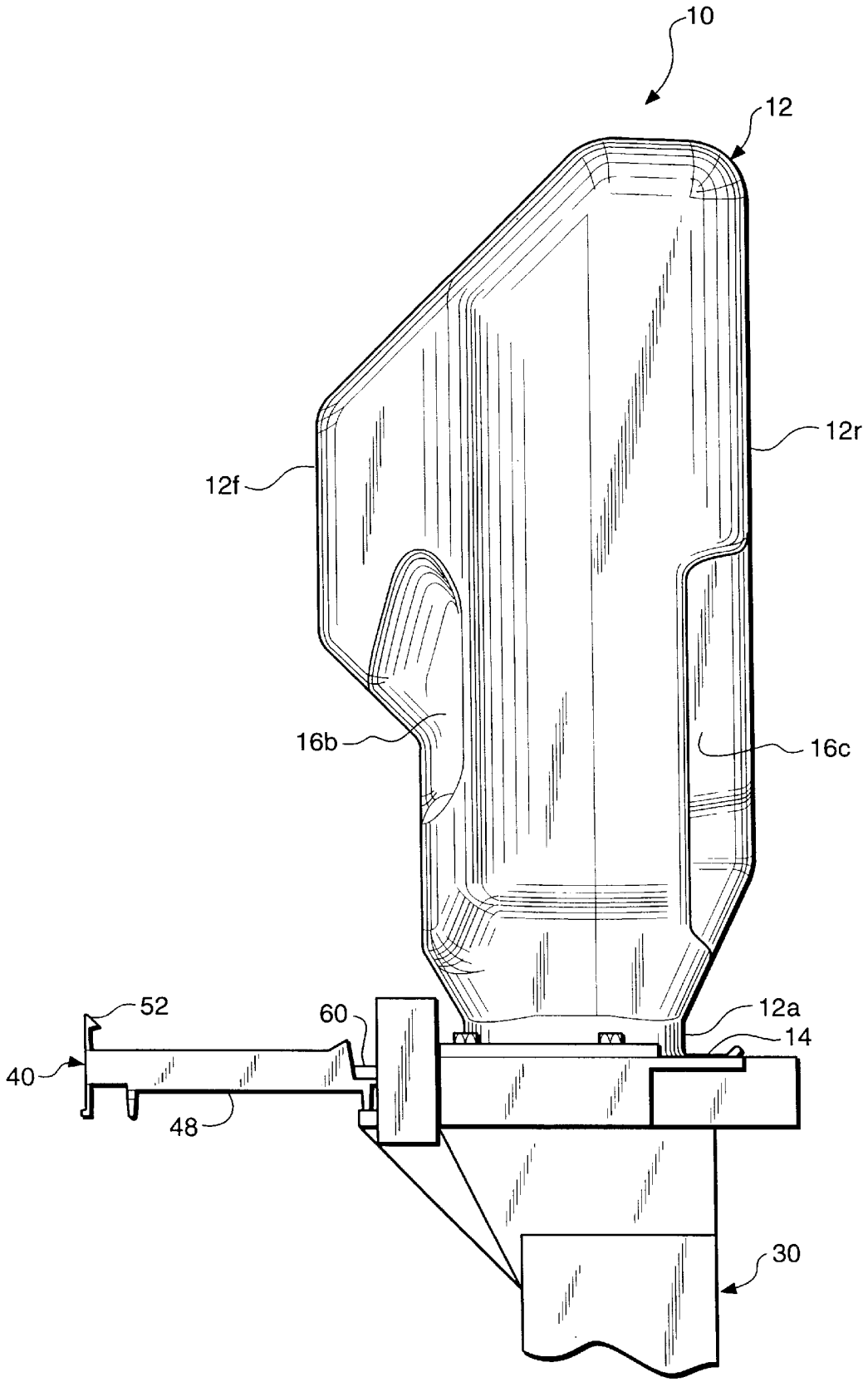
FIG. 4 is a side elevational view of the marking particle receptacle and slide cover as shown in FIG. 1.
Figure 5:
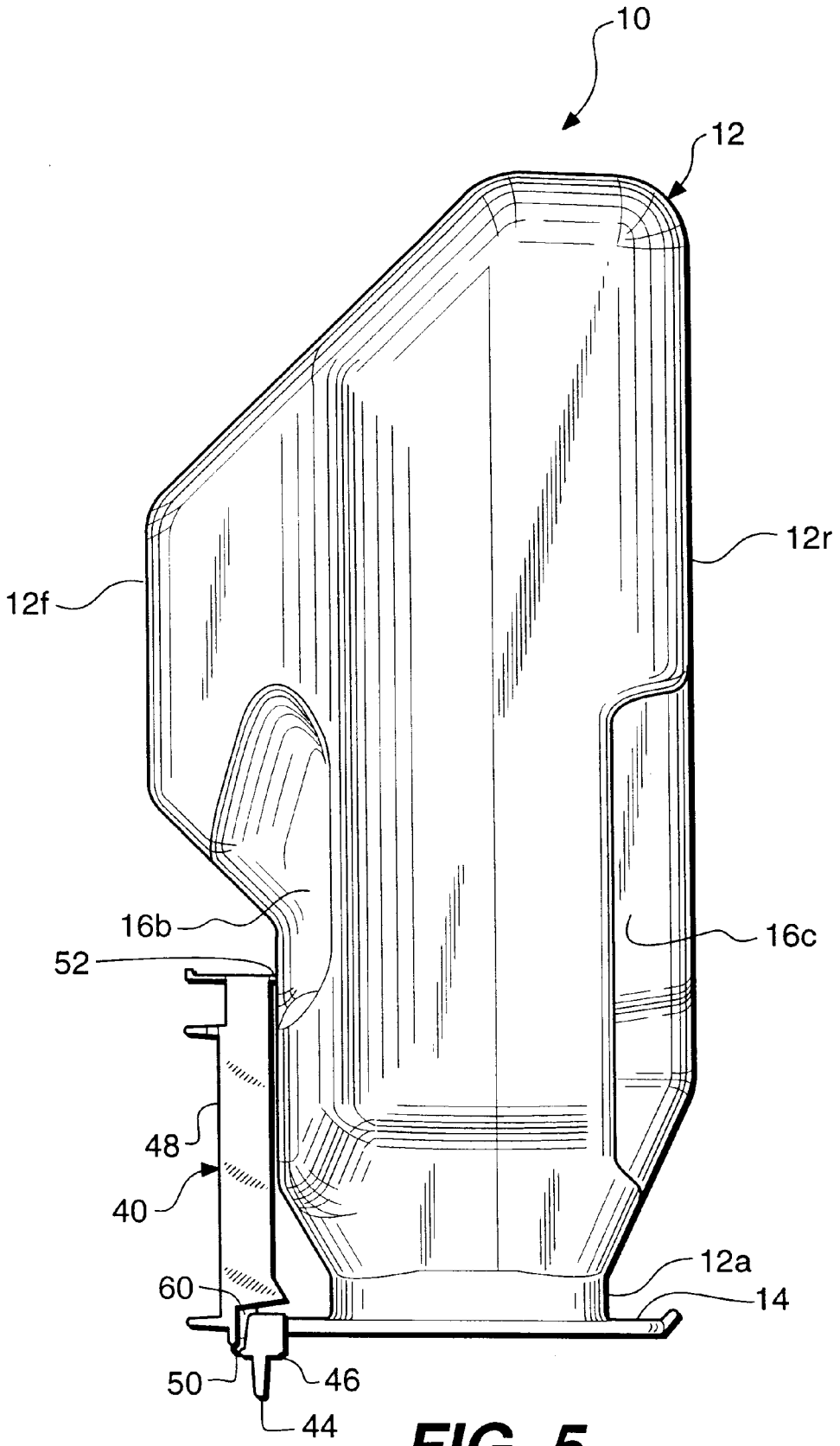
FIG. 5 is a rear elevational view of the marking particle receptacle and slide cover as shown in FIG. 2.
Figure 6:
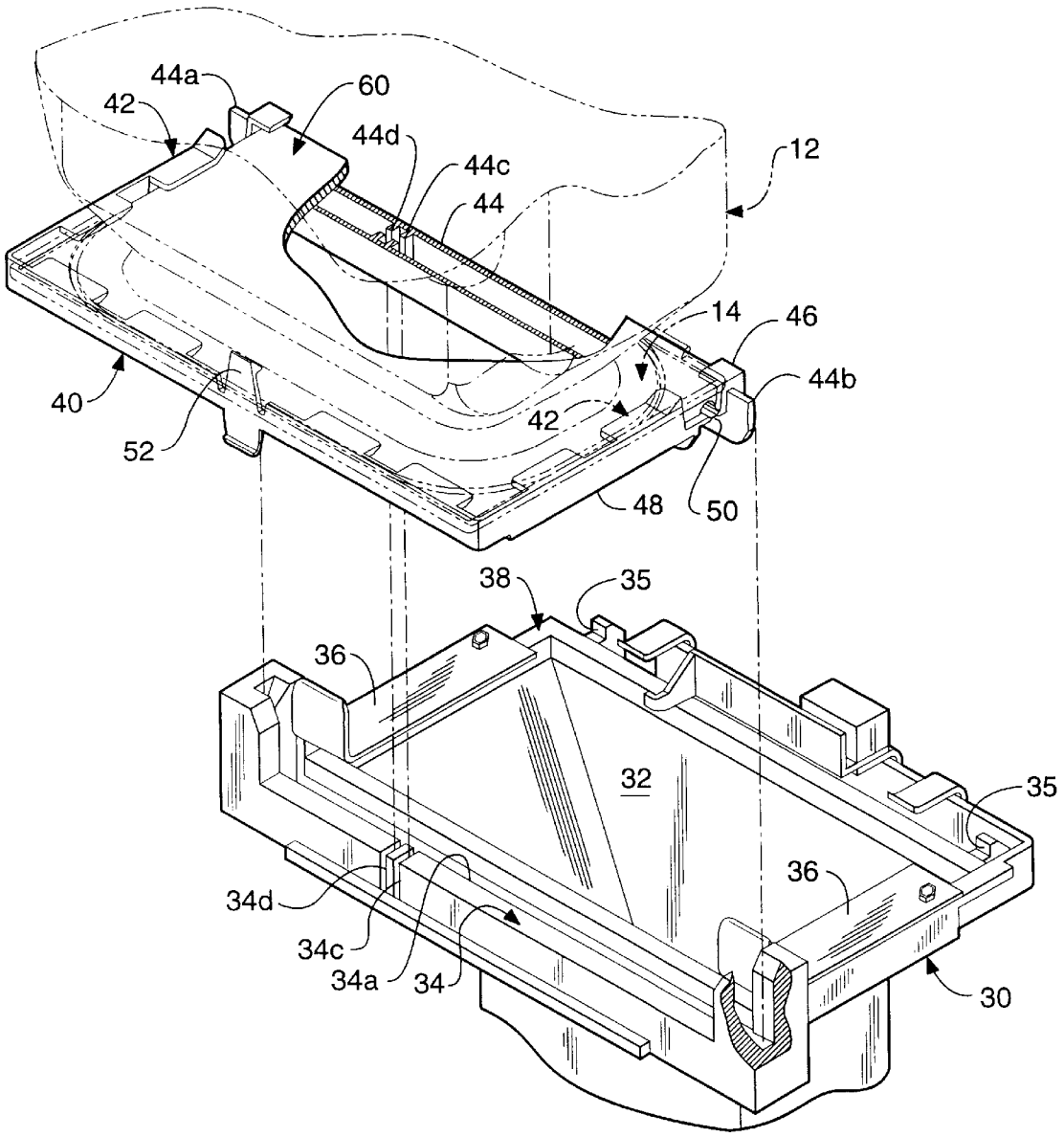
FIG. 6 is an exploded view of the marking particle receptacle and slide cover shown in relation to a replenisher sump.

A marking particle replenisher sump 30 is located in a reproduction apparatus to receive the marking particle receptacle 10, for resupplying the development station of the apparatus with marking particles (see FIG. 6). The replenisher sump 30 defines a cavity 32 for receiving marking particles from the receptacle 10 where they are mixed and fed to a development station of the reproduction apparatus, all by mechanisms well-known in the art and not shown in detail herein. The replenisher sump 30 also includes a receiving surface 34 for receiving and guiding the bottom surface of the flange 14 of the receptacle 10 as the receptacle is moved to a position relative to the replenisher sump into engagement with locating stops 35. Side guides 36 guide the flange 14 of the receptacle 10 as the receptacle is slid by the operator into operative position with its opening over the cavity 32. A resilient seal 38 is located about the perimeter of the replenisher sump 30 generally alongside the entrance to the cavity 32. Once the receptacle 10 is in operative position against the stops 35, relative to the cavity 32, side guides 36 hold flange 14 securely in engagement with the seal 38.

A rigid slide cover 40, according to this invention, is held on flange 14 by side rails 42. The slide cover 40 is preferably formed of plastic. A leading edge reinforcing member 44 for the slide cover engages the front of flange 14 when the slide cover is properly seated on the receptacle 10. As seen best in FIGS. 4, 5, and 7, the slide cover 40 includes a first portion 46 and a second portion 48 interconnected by a hinge 50. The hinge 50 can be formed for example by a conventional thinning of a portion of the slide cover 40. Due to the particular hinge construction, the first portion 46 can be substantially freely rotated relative to the second portion 48. This has particular applicability as explained below.

Figure 7:
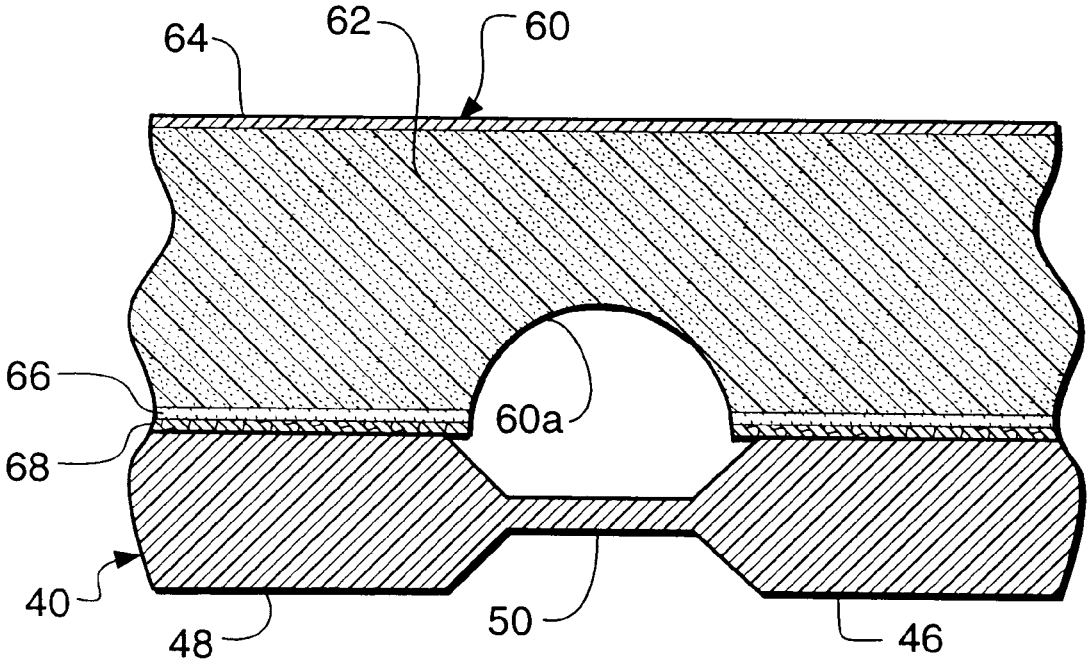
FIG. 7 is a side elevational view, in cross-section, of a portion of the slide cover for the marking particle receptacle, showing the hinge mechanism for the slide cover and foam seal.

Additionally, the slide cover 40 includes a foam seal 60. The foam seal 60 serves to prevent leakage of marking particles into the environment from the receptacle 10 when the receptacle is being loaded into or removed from the reproduction apparatus. The foam seal 60 (as best seen in FIG. 7) includes a layer 62 of, for example, polyolefin foam. One side of the foam layer 62 is covered with a thin sheet 64 of polyolefin for example. Such sheet 64 has a low coefficient of friction so as to facilitate sliding of the flange 14 of the receptacle 10 in the slide cover 40 and to prevent marking particles from sticking to the slide cover.

The opposite side of the foam layer 62 has a pressure sensitive adhesive coating 66 for attaching the foam seal 60 to the slide cover 40. A paper backing layer 68 is applied to the pressure sensitive adhesive coating 66 to protect the coating from contamination. Prior to assembly with the slide cover 40, portions of the backing layer 68 are removed. The portions of the backing layer which are left will enable the foam seal to be readily properly positioned relative to the slide cover during assembly. The removed portions of the backing layer 68 will then enable the foam seal 60 to be secured by the adhesive coating 66 to the slide cover 40 at such proper position. It should also be noted that the foam seal 60 has a groove 60*a* cut into the foam from the pressure sensitive adhesive side. The groove 60*a* is located so that, upon assembly with the slide cover 40, it will substantially overlie the hinge 50. In this manner, the foam seal 60 is readily bent when the first portion 46 is rotated relative to the second portion 48 minimizing the spring tension of the foam and reducing the necessary bending forces to be applied to the slide cover 40.

Once the marking particle receptacle 10 is positioned over the replenisher sump cavity 32, the slide cover 40 extends substantially outwardly from the interface of the receptacle with the cavity (in the manner best shown in FIGS. 1 and 4) in a position beside or to the side of the replenisher sump cavity. Accordingly, the slide cover 40 would be located in a position in which it can interfere with closing of the front door of the reproduction apparatus, or can lead to damage of the slide cover or other reproduction apparatus components. The slide cover hinge 50 is located across the direction of movement of the receptacle 10 relative to the replenisher sump 30. As such, the second portion 48 may be rotated to a position shown in FIGS. 2 and 5, where it is out of the way of, and not restricting, the rest of the reproduction apparatus, i.e., it allows the front door of the reproduction apparatus to be freely closed. The slide cover 40 further includes a latch 52 which is adapted to engage the feature 16*e* (described above) of the container 12. The latch 52 is preferably of a somewhat resilient nature so as to be readily manipulated relative to the feature 16*e*. Accordingly, by the cooperative association of the latch 52 and the recess Of the feature 16*e*, the slide cover 40 can be securely retained in an out of the way location so that damage is prevented.

When the marking particle receptacle 10 has been emptied, the slide cover 40 is lowered to its extended position. That is, latch 52 will be manually manipulated to be disengaged from the feature 16*e*, and then the second portion 48 of the slide cover is rotated about hinge 50 to lie in a substantially planer relation with the first portion 46 (see FIGS. 1 and 4). The marking particle receptacle 10 can then be slid back out onto the extended slide cover 40 for removal and disposal with a minimum loss of unused marking particles and a minimum possibility of soiling the person and clothing of the operator.

It is well known that reproduction apparatus employ marking particles of various compositions and/or characteristics depending, for example, on the particular process utilized by a reproduction apparatus. For example, a color model reproduction apparatus may be designed to take one type of marking particle composition; for example, a marking particle compatible with a fuser using other color marking particles, while another model receives marking particles adapted for a black only apparatus which may not be compatible with a fuser for the color marking particles, but may have other advantages. Also a single reproduction apparatus may utilize two colors of marking particles in development station replenisher sumps which are otherwise substantially identical, for example, a black station and a red or other color station. Further, a single reproduction apparatus may utilize magnetic black marking particles and non-magnetic black marking particles in essentially identical sumps.

Figure 8:
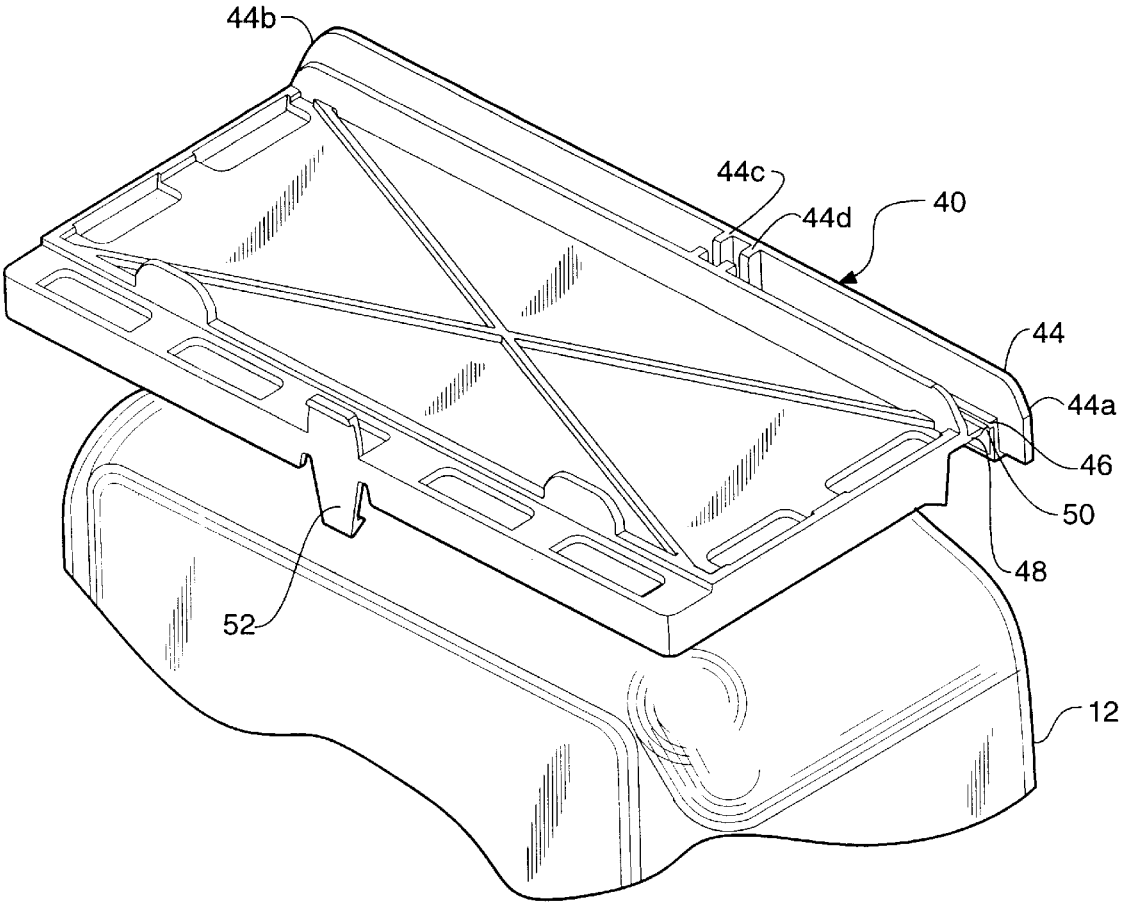
FIG. 8 is a view, in perspective of the slide cover and marking particle receptacle, as shown in FIG. 1, taken from the bottom.

In order to enable the use of common parts in association with a multiplicity of reproduction apparatus, the slide cover 40 for the marking particle receptacle 10, in combination with the replenisher sump 30, contains a simplified system for assuring that a receptacle containing marking particles of a particular composition or characteristic is brought into association only with a reproduction apparatus requiring such particular marking particle composition or characteristic. As best seen in FIG. 8, when the slide cover 40 is manufactured, it is provided in the leading edge reinforcing member 44 with a pair of ears 44*a*, 44*b* at the extremities thereof. Further the leading edge reinforcing member 44 has a series of spaced upstanding identifier ribs 44*c*, 44*d*, etc., located in association with the medial section thereof. Similarly, the receiving surface 34 of the replenisher sump 30 has a guide slot 34*a* and a series of identifying slots 34*c*, 34*d*, etc. (see FIG. 6). The guide slot 34*a* is of a dimension for receiving the reinforcing member 44 (and the ears 44*a*, 44*b*) to properly locate the slide cover 40, and thus the marking particle receptacle 10, in operative association with the replenisher sump 30. The series of identifying slots 34*c*, 34*d*, etc., are for the purpose of receiving the identifying ribs of the slide cover member 44.

According to the composition or characteristics of the marking particles used to fill the receptacle 10, a slide cover will be used which has identifying ribs indicative of that particular marking particle formulation. When an operator attempts to resupply marking particles to a reproduction apparatus utilizing marking particles of a particular composition, the operator must have a marking particle receptacle 10 containing proper marking particle composition. If the identifying ribs in the slide cover align with the identifying slots of the sump receiving surface, the receptacle will be able to be properly associated with the replenisher sump to enable the receptacle to be slid into proper position above the replenisher sump. However, if an operator attempts to put a receptacle containing marking particles of a different composition into the sump, the identifying slots on the replenisher sump receiving surface will interfere with the identifying ribs of the slide cover 40 and prevent proper association of the receptacle relative to the sump.

Figure 9:
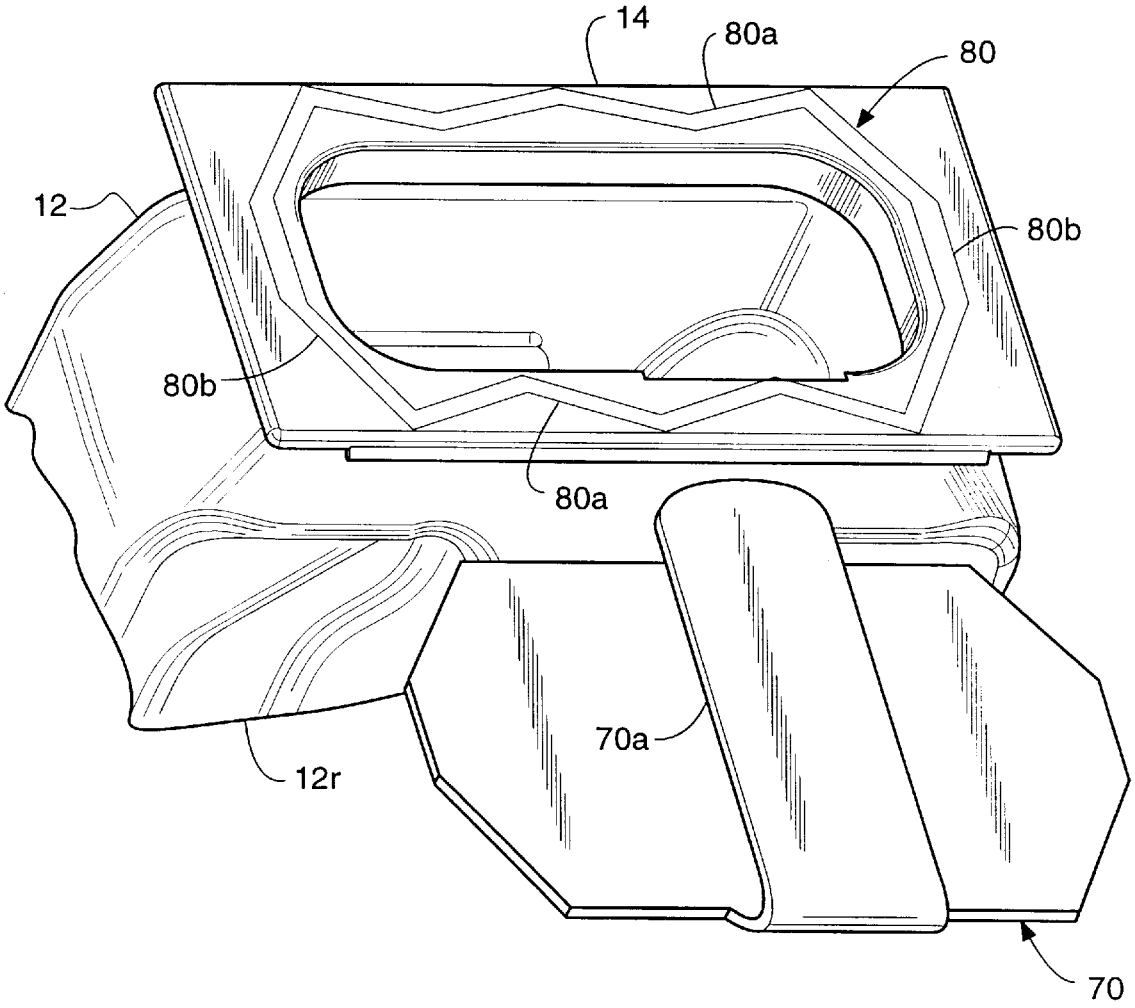
FIG. 9 is a view, in perspective, of the marking particle receptacle flange and the breathable seal therefor.

Additionally, a seal 70 is employed over the bottom of the marking particle receptacle 10 (see FIG. 9). The seal 70 is made of a breathable material such as paper, coated paper, or plastic, for example. In the preferred embodiment, the breathable seal 70 is made of Tyvek™. The purpose of the breathable seal is to retain the marking particles in the receptacle during shipping and handling, while allowing air to pass through such seal. This will prevent pressure differential buildups in the receptacle. Such well known seals are commonly adhesively affixed (bonded) to the bottom of flange 14 to seal the receptacle. The breathable seal 70 is attached beginning with an edge of the seal at the trailing (during insertion) edge of flange 14 and running across the opening of the receptacle to the leading edge adjacent the flange. The seal 70 is folded and doubled back upon itself to present an accessible end 70*a* extending from between flange 14 and the slide cover 40. Accordingly, the end 70*a* of the breathable seal is readily accessible to the operator. After the marking particle receptacle 10 has been operatively positioned above replenisher sump 30, and before the slide cover 40 has been moved to its retained out of the way position, the accessible end 70*a* of the breathable seal 70 is pulled to remove it from the opening to allow the marking particles within the receptacle to drop into the sump cavity. The breathable seal is then thrown away.

As noted above, the receptacle 10 is configured to be larger than presently known receptacles. As a result the breathable seal 70 must be configured to be commensurately larger. With previous design configurations for a breathable seal, the force required to break the adhesive bond for removing the seal would accordingly be substantially increased. The force required to remove the breathable seal 70 from the receptacle 10 has two components. First there is the force required to break the adhesive bond of the seal to the receptacle. For any given adhesive, the removal force is dependent upon the seal bond geometry. By altering the seal bond pattern it is possible to change the amount of force needed to break the adhesive bond. The seal bond 80 has a pattern here established, according to this invention, to reduce the linear seal distance without compromising seal integrity. A sinusoidal, or saw tooth, pattern for the breathable seal bond 80 has been created to lower the removal force. A sinusoidal seal bond 80*a* exists on the back and front of the flange 14 with a linear vertical seal bond 80*b* between them (see FIG. 9). This seal bond configuration reduces the linear seal bond length (direction substantially perpendicular to the pull force vector) at any given point while maintaining a minimum seal bond width.

Second, since the receptacle 10 is loaded on the replenisher sump 30 and sealed thereto with the above described foam seal 60 (to insure a tight seal against marking particle leakage), the breathable seal 70 must be pulled through the foam seal. In prior arrangements, the standard practice is to seal the flange 14 on the sides of the receptacle where the breathable seal is attached. However, according to this invention, by reducing the width of the breathable seal 70 to less than the width of the foam seal 60 on the replenisher sump 30, and keeping it inboard of the replenisher sump foam seal, it is possible to reduce the force required to remove the breathable seal. This is at least in part due to the fact that the breathable seal being pulled off the receptacle flange does not double up beneath the flange at the foam seal (which would otherwise result in additional interference creating higher pull forces). Accordingly, by eliminating the double layer of the breathable seal 70 through the foam seal 60 on the sides of the replenisher sump 30, the removal force is also lowered.

Figure 10:
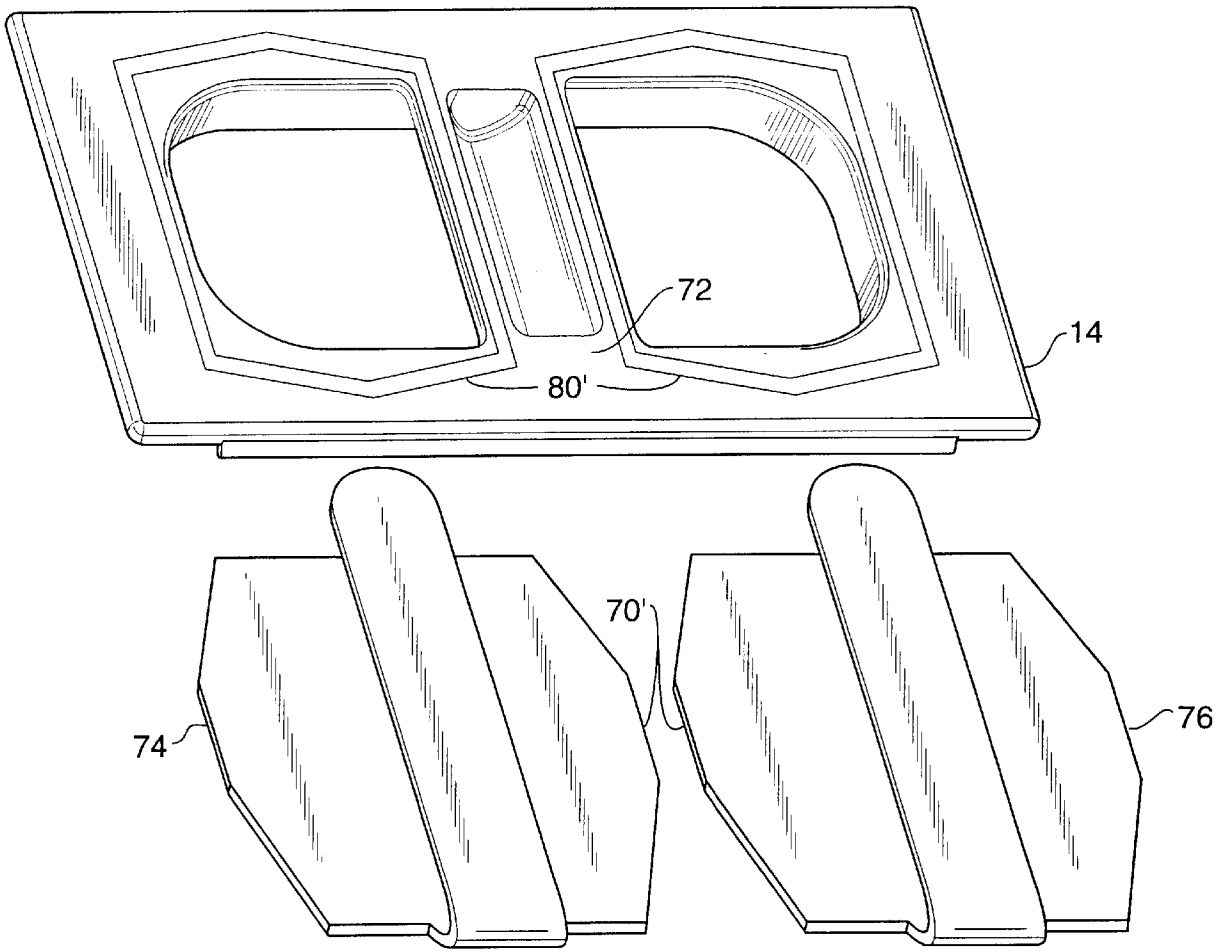
FIG. 10 is a view, in perspective, of an alternate embodiment of the marking particle receptacle flange and the breathable seal therefor.

Alternatively, a double breathable seal 70' (see FIG. 10) can be incorporated into the receptacle flange 14 to reduce the seal removal forces. A center cross rib 72 for example is molded into the receptacle flange to enable two sheets of the breathable seal 74, 76 (for example of the same material as described above) to be independently bonded to the flange.

The center cross rib 72 may be tapered to enable marking particles to be directed into the replenisher sump 30 without hanging up on the cross rib. Splitting the marking particle receptacle mouth into two passages allows the operator to remove a relatively smaller sheet of the breathable seal, one at a time, resulting in lower seal removal forces for each breathable seal. Thus, removal of one breathable seal at a time cuts the removal force substantially in half.

The invention has been described in detail with particular reference to certain preferred embodiments thereof, but it will be understood that variations and modifications can be effected within the spirit and scope of the invention.

PARTS LIST

10—marking particle receptacle
12—container
12*f*—front wall
12*r*—rear wall
14—support flange
16*a*–16*d*—built-in features
16*e*—built-in feature
30—replenisher sump
32—cavity
34—receiving surface
34*a*—guide slot
34*c*, 34*d*—identifying slots
35—stops
36—side guides
38—seal
40—slide cover
42—side rails
44—lead edge reinforcing member
44*a*, 44*b*—ears
44*c*, 44*d*—identifier ribs
46—first portion
48—second portion
50—hinge
52—latch
60—foam seal
60*a*—groove
62—layer
64—sheet
66—adhesive coating
68—paper backing layer
70, 70'—breathable seal
70*a*—accessible end
80, 80'—seal bond

What is claimed is:

1. A receptacle for particulate matter to be supplied to a reproduction apparatus, said receptacle comprising:

a container adapted to store particulate matter, said container having an opening defined therein, and a flange located about said defined opening so as to facilitate placement and removal of the receptacle with the reproduction apparatus; and a slide cover, supported by said flange for selective movement to a first position covering said defined opening and a second position uncovering said defined opening, said container including a feature, and said slide cover including a member cooperating with said feature to releasably secure said slide cover to said container in an out of the way location when said slide cover is in the second position.

2. The receptacle according to claim 1 wherein said feature is a recess, and said member is a latch.

3. The receptacle according to claim 1 wherein said slide cover includes a first portion and a second portion, said first and second portion being joined by a hinge so as to enable said first portion to be substantially freely rotated relative to said second portion.

4. The receptacle according to claim 3 wherein said first and second portions of said slide cover are formed from a single member, and said hinge is defined by a thinned section of said single member to enable said first portion to bend relative to said second portion.

5. A receptacle for particulate matter to be supplied to a reproduction apparatus, said receptacle comprising:

a container adapted to store particulate matter, said container having an opening defined therein, and a flange located about said defined opening so as to facilitate placement and removal of the receptacle with the reproduction apparatus; and a slide cover, supported by said flange for selective movement to a first position covering said defined opening and a second position uncovering said defined opening, said slide cover including a first portion, a second portion, and a seal, said first and second portion being formed from a single member joined by a hinge defined by a thinned section of said single member so as to enable said first portion to be substantially freely rotated relative to said second portion, and said seal overlying said single member and located between said slide cover and said flange when said slide cover is in the first position, said seal including a portion of reduced thickness substantially aligned with said hinge;

wherein said container includes a feature, and said slide cover includes a member cooperating with said feature to releasably secure said slide cover to said container in an out of the way location when said slide cover is in the second position.

6. The receptacle according to claim 5 wherein said seal includes a foam layer and a cover sheet over said foam layer, said cover sheet being formed from a material having a low coefficient of friction.

* * * * *